US007035581B2

(12) United States Patent
Cho et al.

(10) Patent No.: US 7,035,581 B2
(45) Date of Patent: Apr. 25, 2006

(54) FUSING DEVICE FOR AN ELECTROPHOTOGRAPHIC IMAGE FORMING APPARATUS

(75) Inventors: Durk-hyun Cho, Gyeonggi-do (KR); Hwan-geum Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/600,646

(22) Filed: Jun. 23, 2003

(65) Prior Publication Data

US 2004/0042826 A1 Mar. 4, 2004

(30) Foreign Application Priority Data

Aug. 29, 2002 (KR) ..... 10-2002-0051487

(51) Int. Cl.
*G03G 15/20* (2006.01)

(52) U.S. Cl. ..... 399/329; 399/328

(58) Field of Classification Search ..... 399/320, 399/328, 329, 330, 331, 333; 347/156

See application file for complete search history.

(56) References Cited

U.S. PATENT DOCUMENTS

| | | | | |
|---|---|---|---|---|
| 5,365,314 | A * | 11/1994 | Okuda et al. | 399/329 X |
| 5,860,052 | A * | 1/1999 | Ohtsuka et al. | 399/329 |
| 5,932,125 | A * | 8/1999 | Kawata et al. | 399/333 X |
| 5,999,764 | A * | 12/1999 | Okabayashi et al. | 399/329 X |
| 6,040,558 | A * | 3/2000 | Yamazaki | 399/329 X |
| 6,137,985 | A * | 10/2000 | Kinouchi et al. | 399/329 |
| 6,185,383 | B1 * | 2/2001 | Kanari et al. | 399/328 X |
| 6,339,211 | B1 * | 1/2002 | Foote et al. | 399/328 X |
| 6,564,033 | B1 * | 5/2003 | Zhou et al. | 399/329 |
| 6,713,725 | B1 * | 3/2004 | Izawa et al. | 399/329 X |

FOREIGN PATENT DOCUMENTS

JP 9-222811 8/1997

* cited by examiner

*Primary Examiner*—Sandra L. Brase
(74) *Attorney, Agent, or Firm*—Staas & Halsey LLP

(57) ABSTRACT

A fusing device of an electrophotographic image forming apparatus includes a fusing unit which includes a heating portion, a fixing frame which fixes and supports the heating portion at one side, and a fusing film sliding along a circumference of the fixing frame, and a pressing roller which presses the fusing film to the heating portion to slide the fusing film. The heating portion is installed in contact with the pressing roller and forms a fusing nip portion having a predetermined width.

14 Claims, 4 Drawing Sheets

FUSING DEVICE FOR AN ELECTROPHOTOGRAPHIC IMAGE FORMING APPARATUS

CROSS-REFERENCE TO RELATED APPLICATIONS

This application claims the benefit of Korean Application No. 2002-51487, filed Aug. 29, 2002, in the Korean Intellectual Property Office, the disclosure of which is incorporated herein by reference.

BACKGROUND OF THE INVENTION

1. Field of the Invention

The present invention relates to a fusing device of an electrophotographic image forming apparatus, and more particularly, to a fusing device of an electrophotographic image forming apparatus that provides a portion in which a fusing nip having a predetermined width is formed, in advance.

2. Description of the Related Art

In general, an electrophotographic printer includes a fusing device which heats the paper onto which a toner image is transferred, melts the toner image in a powder state on the paper, and fuses the melt toner image on the paper. The fusing device includes a fusing roller which fuses toner on the paper, and a pressing roller which pushes the paper against the fusing roller.

FIG. 1 is a schematic profile cross-sectional view of a conventional fusing roller using a halogen lamp as a heat source, and FIG. 2 is a schematic cross-sectional view of a conventional fusing device using the fusing roller of FIG. 1. Referring to FIG. 1, a fusing roller 10 includes a cylindrical roller 11 and a halogen lamp 12 installed inside the cylindrical roller 11. A Teflon coating layer 11*a* is formed on a circumference of the cylindrical roller 11. The cylindrical roller 11 is heated by radiant heat generated from the halogen lamp 12.

Referring to FIG. 2, a pressing roller 13 is placed under the fusing roller 10 to be opposite to the fusing roller 10, and paper 14 is placed between the fusing roller 10 and the pressing roller 13. The pressing roller 13 is elastically supported by a spring 13*a* and closely adheres to the paper 14, passing between the fusing roller 10 and the pressing roller 13, to the fusing roller 10 with a predetermined pressure. In this case, the paper 14 on which a toner image 14*a* in a powder state is formed, is fused on the paper 14 due to the predetermined pressure and heat while passing between the fusing roller 10 and the pressing roller 13.

A thermistor 15 and a thermostat 16 are installed at one side of the fusing roller 10. The thermistor 15 measures a surface temperature of the fusing roller 10, and the thermostat 16 cuts off power supplied to the halogen lamp 12 when the surface temperature of the fusing roller 10 exceeds a predetermined value. The thermistor 15 measures the surface temperature of the fusing roller 10 and transmits an electrical signal measured corresponding to the measured temperature to a controller (not shown) of a printer (not shown). The controller controls the power supplied to the halogen lamp 12 according to a measured temperature and maintains the surface temperature of the fusing roller 11 within a given range. When the temperature of the fusing roller 11 exceeds the predetermined set value because the controller fails to control the temperature of the fusing roller 11, a contact (not shown) of the thermostat 16 opens to cut off the supply of power to the halogen lamp 12.

Power consumption of a conventional fusing device using a halogen lamp as a heat source is large. In particular, the conventional fusing device requires a substantial warming-up time when power is turned on to the fusing device. In particular, in the conventional fusing device, the fusing roller is heated by radiant heat generated from the heat source. Thus, a heat transfer is slow, and compensation for a difference in temperature due to a temperature decrease caused by contacting the paper is also slow, causing difficulty in maintaining the fusing roller 10 at a predetermined temperature.

Accordingly, it is difficult to apply the conventional fusing device to a printer requiring a rapid fusing heat supply, such as a color laser printer or a black-and-white laser printer, for high-speed printing of 25 sheets per minute.

In addition, when the conventional fusing device having the above structure is used in a color laser printer or a high-speed laser printer, the diameter of the fusing roller should increase. In order to improve heat transfer onto paper which moves at a high-speed, or heat transfer onto paper on which a toner image is overlapped, the width of a fusing nip needs to be increased.

SUMMARY OF THE INVENTION

The present invention provides a fusing device for an electrophotographic image forming apparatus that reduces a warming-up time using a heat pipe and provides a portion where a fusing nip is formed, in advance to increase the width of the fusing nip.

According to one aspect of the present invention, a fusing device of an electrophotographic image forming apparatus includes a fusing unit which includes a heating portion, a fixing frame which fixes and supports the heating portion at one side, a fusing film sliding along a circumference of the fixing frame, and a pressing roller which presses the fusing film to the heating portion to slide the fusing film. The heating portion is installed in contact with the pressing roller, and forms a fusing nip portion having a predetermined width.

The heating portion includes a heat pipe, both ends of which are sealed and in which a predetermined amount of a working fluid is contained, an insulating material which surrounds the heat pipe, a resistive coil which winds the insulating material and heats the heat pipe, and a nip plate at a lower portion of the resistive coil to contact the pressing roller through the fusing film and to form the fusing nip portion.

The nip plate may be formed of a ceramic material selected from a group of SiC, MgO, and $Al_2O_3$.

The width of the nip plate at a printing route may be 3–10 mm.

Additional aspects and advantages of the invention will be set forth in part in the description which follows and, in part, will be obvious from the description, or may be learned by practice of the invention.

In addition, a halogen lamp which is a heater to heat the pressing roller, may be placed inside the pressing roller.

One surface of the heat pipe is closely adhered to the nip plate to transfer heat to the nip plate.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
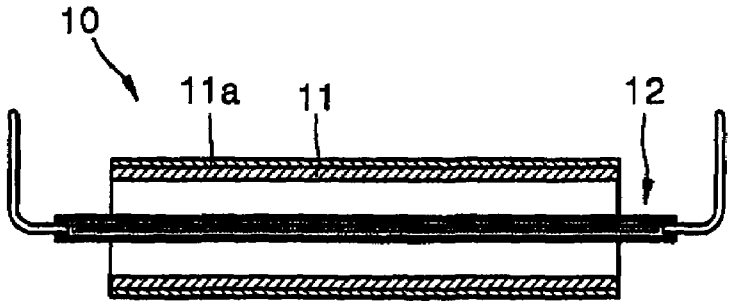
FIG. 1 (PRIOR ART)
FIG. 1 is a schematic profile cross-sectional view of a conventional fusing roller using a halogen lamp as a heat source.
Figure 2:
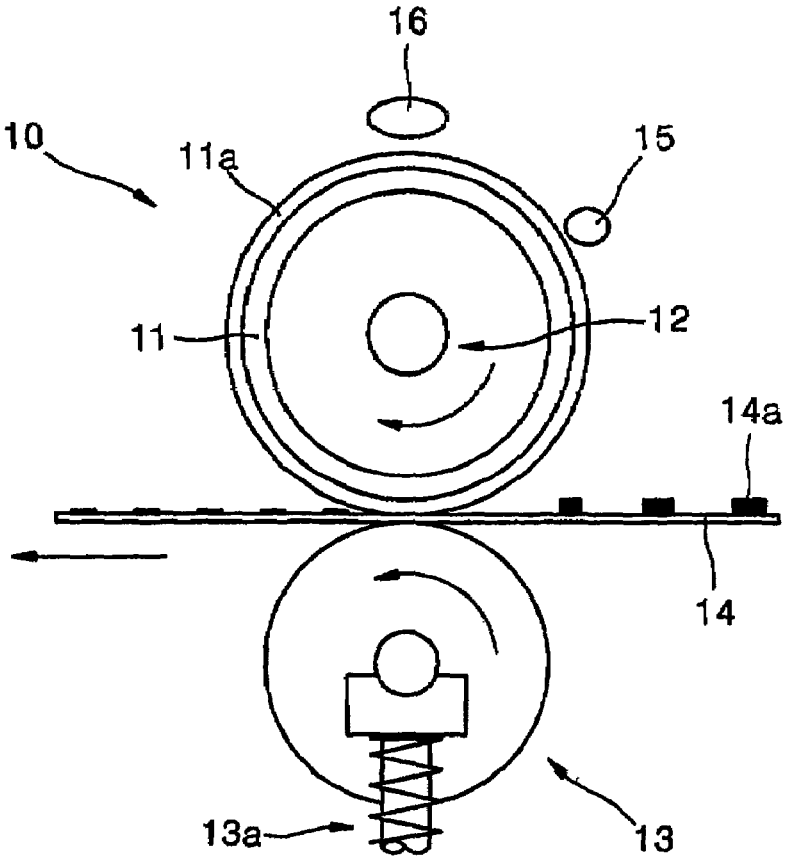
FIG. 2 (PRIOR ART)
FIG. 2 is a schematic cross-sectional view of a conventional fusing device using the fusing roller of FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, preferred embodiments of the present invention are described in detail with reference to accompanying drawings. Thicknesses of layers or regions shown in drawings are exaggerated for clarity of a specification.

Figure 3:
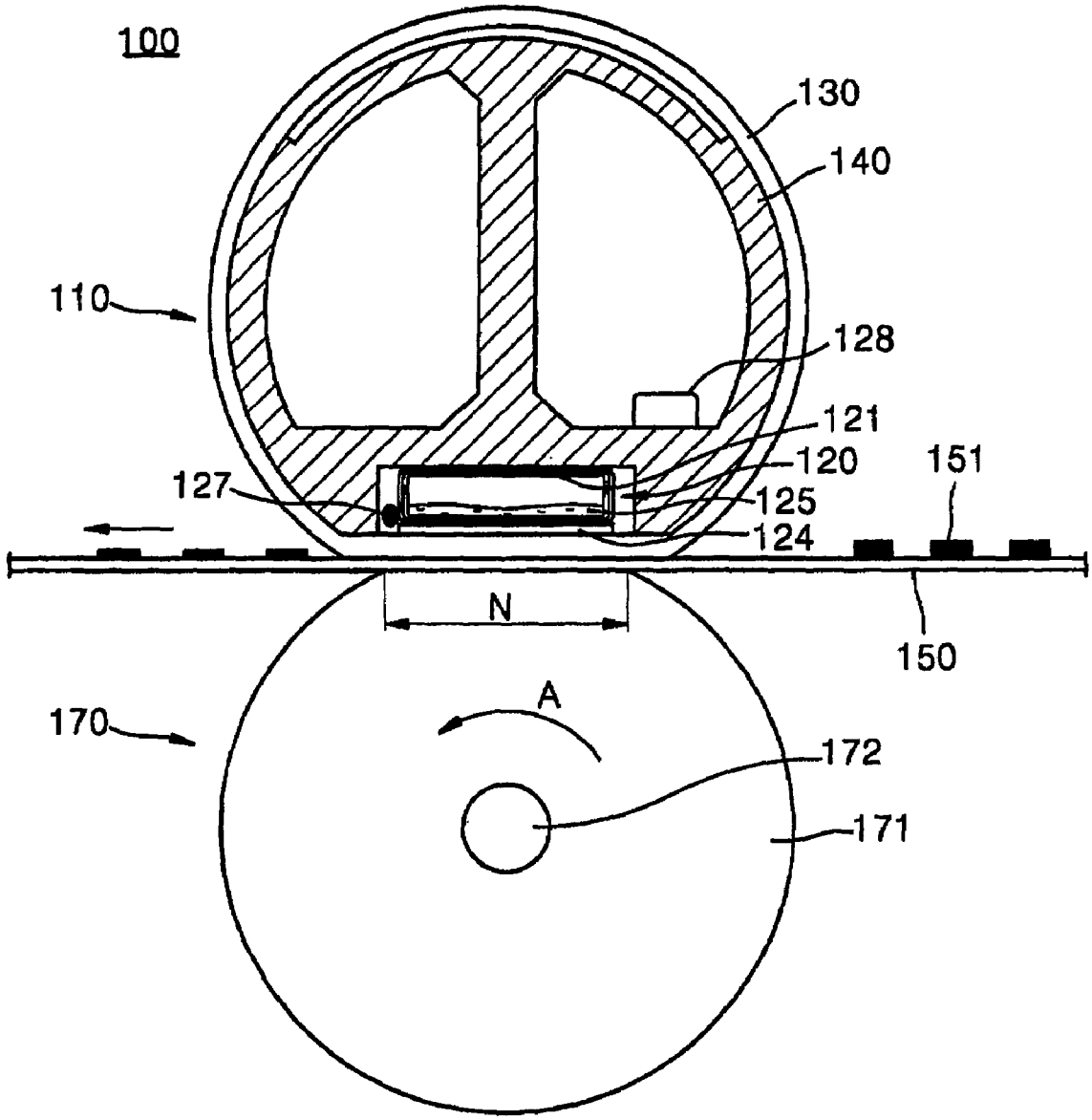
FIG. 3 is a schematic cross-sectional view of a fusing device of an electrophotographic image forming apparatus according to a first embodiment of the present invention.
Figure 4:
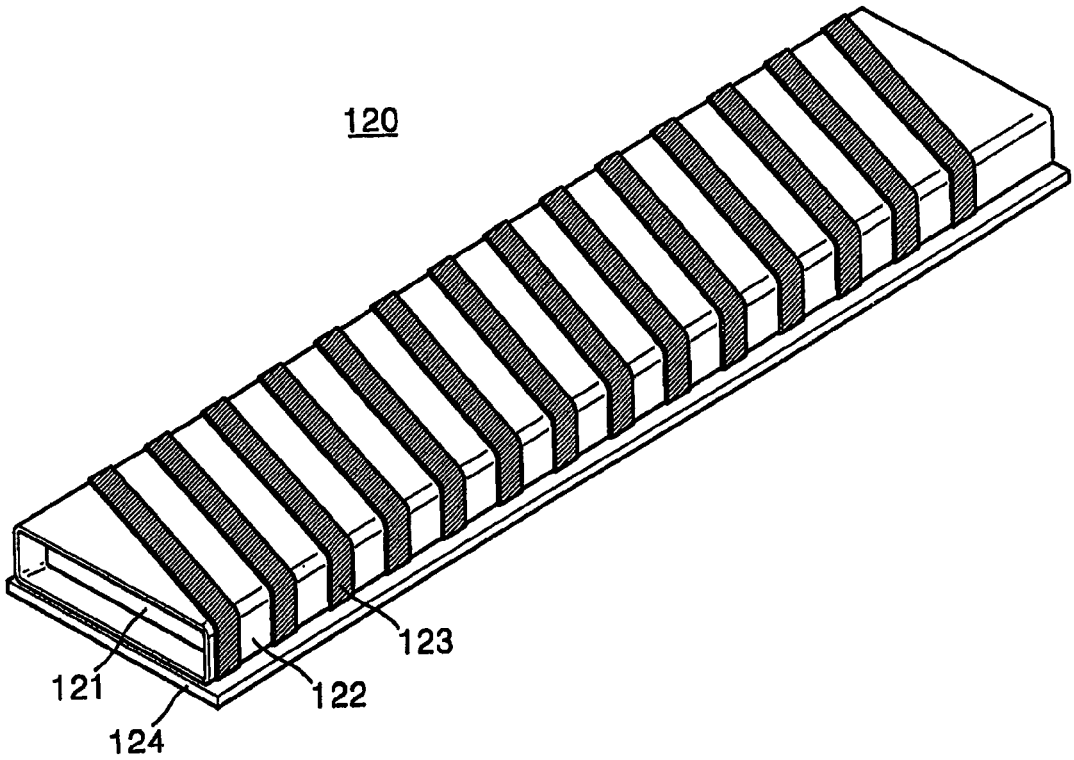
FIG. 4 is an enlarged perspective view of a heating portion of FIG. 3.

FIG. 3 is a schematic cross-sectional view of a fusing device for an electrophotographic image forming apparatus according to a first embodiment of the present invention, and FIG. 4 is an enlarged perspective view of a heating portion of FIG. 3. Referring to FIGS. 3 and 4, a fusing device 100 includes a pressing roller 170 which rotates in a direction in which a sheet of printer paper 150 having a toner image 151 thereon is ejected, i.e., in a direction indicated by an arrow A. A fusing unit 110 is installed to face the pressing roller 170 through the paper 150 and fuses the toner image 151 formed on the paper 150 at a fusing nip N formed between the fusing unit 110 and the pressing roller 170.

The fusing unit 110 includes a heating portion 120 having the fusing nip portion N at one face, a fusing film 130 which slides the fusing nip portion N, and a fixing frame 140 which guides the fusing film 130 and fixes the heating portion 120 at one side. The fusing nip portion N is formed to a predetermined thickness, for example, to a thickness of 6–7 mm, to aid fusing of the toner image 151 on the paper 150, which passes at a high speed in a high-speed laser printer. Also, the fusing nip N aids fusing of an overlapped toner image in a color laser printer.

The heating portion 120 includes a heat pipe 121, both ends of which are sealed and in which a predetermined amount of a working fluid is contained, an insulating material 122 which surrounds the heat pipe 121, a resistive coil 123 which winds the insulating material 122 to heat the heat pipe 121, and a nip plate 124 which is placed at a lower side of the heat pipe 121. The nip plate 124 insulates the resistive coil 123, and transfers heat generated from both the heat pipe 121 and the resistive coil 123, to the fusing film 130.

The heat pipe 121 is formed in a tube shape, and both ends are sealed. A predetermined amount of a working fluid 125 is contained in the heat pipe 121. The working fluid 125 is vaporized by heat generated at the resistive coil 123 and serves as a thermal medium which transfers the heat to the nip plate 124, prevents a temperature deviation at the fusing nip portion N, and heats the overall nip plate 124 quickly. The working fluid 125 has a volume ratio of 5–50% with respect to a volume of the heat pipe 121; for example, 5–15% of the volume of the heat pipe 121 is a workable volume ratio. However, a volume ratio of the working fluid 125 less than 5% is not preferable because a dry out is highly likely to occur.

The working fluid 125 is selectively used depending on the material of the heat pipe 121. That is, if the material of the heat pipe 121 is made of stainless steel, most known fluids, excluding water, may be used as the working fluid 125.

If the material of the heat pipe 121 is copper (Cu), most known fluids may be used as the working fluid 125, and among them, water, i.e., distilled water, is the most preferable. When water or distilled water is used as the working fluid 125, costs for the working fluid 125 are reduced, and environmental contamination does not occur.

A Ni—Cr resistor or a Cr—Fe wire, which generates heat by electricity supplied from an external power supply, may be used as the resistive coil 123.

The insulating material 122, such as mica sheet or glass coating, is placed between the resistive coil 123 and the heat pipe 121. However, if the insulating nip plate 124 and the fixing frame 140 are placed at an outer surface of the resistive coil 123, an additional insulating material is not needed.

A ceramic material, such as MgO, SiC, or $Al_2O_3$, having a high heat transfer rate and a high heat-resistant property, is typically used for the nip plate 124. The width of the nip plate 124 at a printing route may be 3–10 mm in consideration of the width of the fusing nip N of about 2–8 mm and a margin of 1–2 mm at both ends.

The fixing frame 140 is formed of a material which is not deformed at a fusing temperature of 160–190 C. The fixing frame 140 is formed by injection molding using a resin, such as polyphenylene sulfide (PPS) or polybutylene terephthalate (PBT) in which a filler such as glass fiber is inserted.

The fusing film 130 may have a thickness of 50–1000 μm, and polyimide is used at a side contacting the nip plate 124, and Teflon coating, which is a toner protective layer, is formed at a side contacting the toner image 150.

A thermistor 127 is installed at one side of the heating portion 120. The thermistor 127 measures a surface temperature of the nip plate 124. Also, there is a thermostat 128 which cuts off power supplied to the resistive coil 123 to prevent overheating when the surface temperature of the nip plate 124 is rapidly increased.

The pressing roller 170 includes an elastic roller 171 which contacts the nip plate 124 and forms a fusing nip N therebetween, and a shaft 172 which supports the elastic roller 171 and is rotated by a driving unit (not shown). The elastic roller 171 may be formed of a heat-resistant silicon rubber. The fusing film 130 is rotated along the circumference of the fixing frame 140 by a rotation of the elastic roller 171.

The operation of the fusing device of an electrophotographic image forming apparatus having the above structure according to the present invention is described in detail with reference to the accompanying drawings.

The resistive coil 123 generates heat when electricity from an external power supply is supplied to the resistive coil 123. Part of the heat is transferred to the nip plate 124, and the other part of the heat is transferred to the heat pipe 121. The working fluid 125 contained in the heat pipe 121 is heated and vaporized, and the heat of the working fluid 125 in a gaseous state is transferred to the fusing film 130 through the insulating material 122 and the nip plate 124 on the surface of the heat pipe 121. The heat of the working fluid 125 is transferred to the fusing film 130 such that the surface temperature of the fusing film 130 reaches a target temperature required to fuse the toner 151 in a powder state formed on the paper 150 quickly.

Subsequently, in a printing mode, the toner 151 in a powder state is transferred onto the paper 150, and the paper 150 passes between the fusing unit 110 and the pressing roller 170. The toner 151 is fused on the paper 150 by the fusing film 130 that is heated at a predetermined temperature.

As the fusing film 130 fuses the toner image 151 on the paper 150, the heat of the fusing film 130 is absorbed by the paper 150. The working fluid 125 inside the heat pipe 121 loses the heat and is liquefied. Then, the working fluid 125 to which the heat is transferred by the resistive coil 123, is vaporized such that the surface temperature of the fusing film 130 at the fusing nip N is maintained at a target temperature suitable to fuse the toner 151 on the paper 150.

In general, a fusing temperature of a toner image is about 160–190° C. The thermistor 127 measures the surface temperature of the nip plate 124 and a controller (not shown) maintains the surface temperature of the nip plate 124 within a predetermined range suitable to fuse the toner 151 on the paper 150. If adjustment of the surface temperature fails and the surface temperature of the nip plate 124 rapidly increases, the thermostat 128 cuts off power connected to the resistive coil 123 through a mechanical operation. This power supply operation may be varied according to a set temperature and may be performed using a controlling methods, such as periodic on/off, pulse width modulation (PWM), or proportional and integral (PI).

Figure 5:
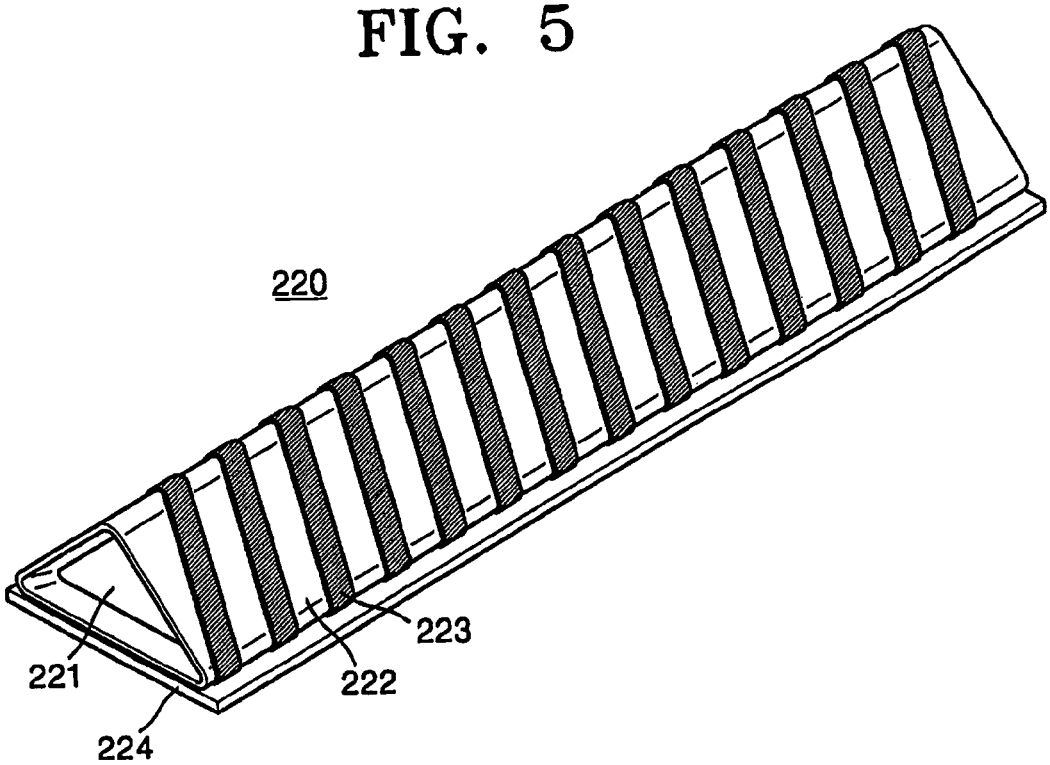
FIG. 5 shows a modification example of the heating portion of FIG. 4.

FIG. 5 is a perspective view illustrating a modification of the heating portion of FIG. 4. Referring to FIG. 5, the sectional shape of a heat pipe 221 of a heating portion 220 is a triangular shape, and one side of the heat pipe 221 is closely adhered to an upper portion of the nip plate 224. Likewise, the heat pipe 221 may be formed in various shapes, but heat transfer is easily performed when one side is closely adhered to the nip plate 224.

Figure 6:
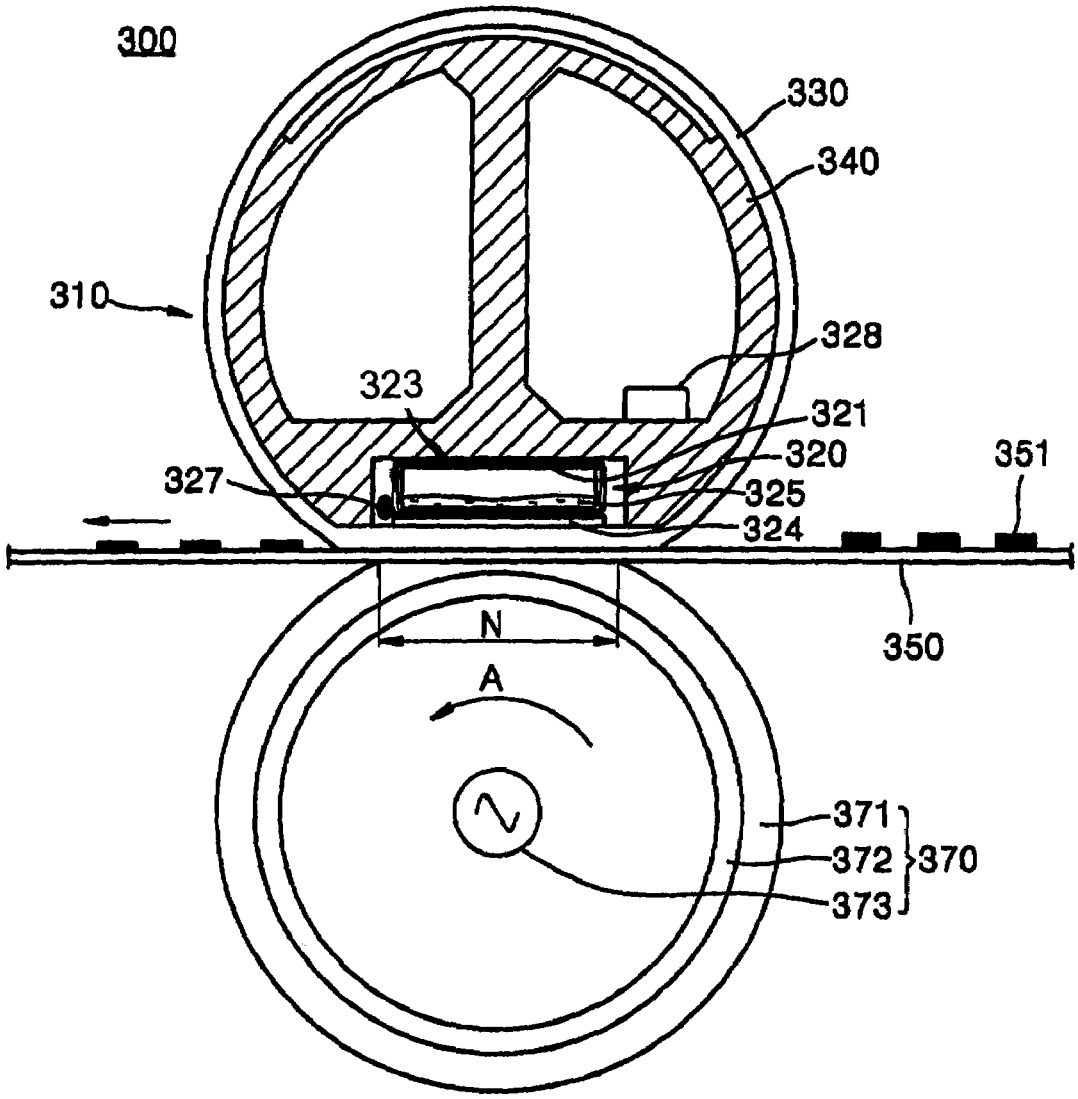
FIG. 6 is a schematic cross-sectional view of the fusing device of an electrophotographic image forming apparatus according to a second embodiment of the present invention.

FIG. 6 is a schematic cross-sectional view of the fusing device of an electrophotographic image forming apparatus according to a second embodiment of the present invention. Like names or reference numerals are used in like elements as those of the first embodiment, and detailed descriptions thereof will be omitted.

Referring to FIG. 6, a fusing device 300 includes a pressing roller 370 which rotates in a direction in which a sheet of print paper 350 having a toner image 351 thereon is ejected, i.e., in a direction indicated by an arrow A. A fusing unit 310 is installed to face the pressing roller 370 through the paper 350 and fuses the toner image 351 formed on the paper 350 at a fusing nip N formed between the fusing unit 310 and the pressing roller 370.

The fusing unit 310 includes a heating portion 320 having the fusing nip portion N at one face, a fusing film 330 which slides the fusing nip portion N, and a fixing frame 340 which guides the fusing film 330 and fixes the heating portion 320 at one side.

The heating portion 320 includes a heat pipe 321, an insulating material (122 of FIG. 4; 222 of FIG. 5), a resistive coil (123 of FIG. 4; 223 of FIG. 5), and a nip plate 324.

A thermistor 327 is installed at one side of the heating portion 320. The thermistor 327 measures a surface temperature of the nip plate 324. Also, there is a thermostat 328 (128 in FIG. 3) which cuts off power supplied to the resistive coil 323 to prevent overheating when the surface temperature of the nip plate 324 is rapidly increased.

The pressing roller 370 includes an elastic roller 371 (171 in FIG. 3) which contacts the nip plate 324 and forms a fusing nip N therebetween, and a rotation roller 372 (172 in FIG. 3) which supports the elastic roller 371 on the surface of the elastic roller 371 and is rotated by a driving unit (not shown). A halogen lamp 373 which generates heat and heats the rotation roller 372, is placed inside the rotation roller 372. The fusing film 330 is rotated along the circumference of the fixing frame 340 by a rotation of the elastic roller 371.

The operation of the fusing device of an electrophotographic image forming apparatus having the above structure according to the present invention is described in detail with reference to the accompanying drawings.

The resistive coil 323 generates heat when electricity from an external power supply is supplied to the resistive coil 323. Part of the heat is transferred to the nip plate 324, and the other part of the heat is transferred to the heat pipe 321. A working fluid 325 contained in the heat pipe 321 is heated and vaporized, and the heat of the working fluid 325 in a gaseous state is transferred to the fusing film 330 through the insulating material 322 and the nip plate 324 on the surface of the heat pipe 321. The heat of the working fluid 325 is transferred to the fusing film 330 such that the surface temperature of the fusing film 330 reaches a target temperature required to fuse the toner 351 in a powder state formed on the paper 350 on the paper 350 quickly.

Electricity is also supplied to the halogen lamp 373, and the temperature of the rotation roller 372 is increased to a predetermined temperature. The heated rotation roller 372 compensates for a fusing heat consumed in the fusing unit 310. Thus, this structure of the pressing roller 370 is effectively used in a high-speed laser printer and a color laser printer.

Subsequently, in a printing mode, the toner 351 in a powder state is transferred onto the paper 350, and the paper 350 passes between the fusing unit 310 and the pressing roller 370. The toner 351 is fused on the paper 350 by the fusing film 330 heated at a predetermined temperature and the pressing roller 370. The fusing film 330 rotates along the circumference of the fixing frame 340.

As the fusing film 330 fuses the toner image 351 on the paper 350, the heat of the fusing film 330 is absorbed by the paper 350. The working fluid 325 inside the heat pipe 321 loses the heat and is liquefied. Then, the working fluid 325 to which heat is transferred by the resistive coil 323, is vaporized such that the surface temperature of the fusing film 330 is maintained at a target temperature suitable to fuse the toner 351 on the paper 350.

A thermal load of the fusing unit 310 of the fusing device 300 according to the second embodiment of the present invention is reduced compared with the thermal load of the fusing device 100 according to the first embodiment of the present invention. Also, a warming-up time of the fusing device 300 according to the second embodiment of the present invention is faster compared with the warming-up time of the fusing device 100 according to the first embodiment of the present invention.

As described above, in the fusing device of an electrophotographic image forming apparatus according to the present invention, a warming-up time required for an initial printing is reduced using a heat pipe, and a fusing nip having a predetermined width is formed such that the fusing device is effectively used in a color laser printer and a high-speed laser printer having a high fusing heat.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing device of an electrophotographic image forming apparatus, the device comprising:

a fusing unit which includes a heating portion, a fixing frame which fixes and supports the heating portion at one side, and a fusing film sliding along a circumference of the fixing frame, wherein the heating portion comprises a heat pipe, both ends of which are sealed and in which a predetermined amount of a working fluid is contained; and a pressing roller which presses the fusing film to the heating portion to slide the fusing film;

wherein the heating portion is in contact with the pressing roller and forms a fusing nip portion having a predetermined width, and wherein the heating portion further comprises:

an insulating material which surrounds the heat pipe;

a resistive coil which winds the insulating material and heats the heat pipe; and a nip plate at a lower portion of the resistive coil to contact the pressing roller through the fusing film and to form the fusing nip portion.

2. The device of claim 1, wherein the nip plate is formed of a ceramic material selected from a group consisting of SiC, MgO, and $Al_2O_3$.

3. The device of claim 2, wherein the width of the nip plate at a printing route is 3–10 mm.

4. The device of claim 1, further comprising a heater which heats the pressing roller, is placed inside the pressing roller.

5. The device of claim 4, wherein the heater is a halogen lamp.

6. The device of claim 1, wherein one surface of the heat pipe is closely adhered to the nip plate to transfer heat to the nip plate.

7. The device of claim 1, wherein the fixing frame is manufactured by injection molding.

8. A method of fusing an electrophotographic image in an image forming apparatus, the method comprising:

heating a heating portion contiguous to a path over which a material having an electrophotographic image passes and controlling a heat of the heating portion by:

using a predetermined amount of a working fluid in a heat pipe of the heating portion to absorb heat;

fixing and supporting a fixing frame to facilitate sliding a fusing film along a circumference of the fixing frame;

pressing the fusing film to the heating portion to slide the fusing film so that a fusing nip portion having a predetermined width is formed, and controlling a heat of the heating portion by:

using an insulating material to surround the heat pipe; and using a resistive coil wound around the insulating material to heat the heat pipe, wherein a nip plate at a lower portion of the resistive coil contacts a pressing roller through the fusing film to form the fusing nip portion.

9. The method of claim 8, wherein the nip plate is formed of a ceramic material selected from a group consisting of SiC, MgO, and $Al_2O_3$.

10. The method of claim 9, wherein the width of the nip plate at a printing route is 3–10 mm.

11. The method of claim 8, further including using a heater inside the pressing roller to heat the pressing roller.

12. The method of claim 8, wherein the fusing unit uses a halogen lamp to heat the pressing roller.

13. The method of claim 8, including closely adhering a surface of the heat pipe to the nip plate to transfer heat to the nip plate.

14. A fusing device of an electrophotographic image forming apparatus, the device comprising:

a fusing unit which includes a heating portion, a fixing frame which fixes and supports the heating portion at one side, and a fusing film sliding along a circumference of the fixing frame;

a pressing roller which presses the fusing film to the heating portion to slide the fusing film, wherein the heating portion is in contact with the pressing roller and forms a fusing nip portion having a predetermined width; and a nip plate to contact the pressing roller through the fusing film and to form the fusing nip portion, wherein the heating portion comprises:

a heat pipe;

an insulating material surrounding the heat pipe; and a resistive coil winding the insulating material and heating the heat pipe.

* * * * *